US011089939B2

(12) United States Patent
Staun

(10) Patent No.: US 11,089,939 B2
(45) Date of Patent: Aug. 17, 2021

(54) DISHWASHER WITH DETERGENT STORAGE

(71) Applicant: Midea Group Co., Ltd., Foshan (CN)

(72) Inventor: Paul R. Staun, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 254 days.

(21) Appl. No.: 15/901,462

(22) Filed: Feb. 21, 2018

(65) Prior Publication Data

US 2019/0254498 A1 Aug. 22, 2019

(51) Int. Cl.
*A47L 15/42* (2006.01)
*A47L 15/44* (2006.01)

(52) U.S. Cl.
CPC ..... *A47L 15/4463* (2013.01); *A47L 15/4257* (2013.01)

(58) Field of Classification Search
CPC .. A47L 15/4257; A47L 15/44; A47L 15/4409; A47L 15/4463; A47L 15/4472; A47L 15/4445; B65D 50/061
See application file for complete search history.

(56) References Cited

U.S. PATENT DOCUMENTS

| | | | | |
|---|---|---|---|---|
| 3,871,662 | A * | 3/1975 | Hepp | B65D 50/061 215/223 |
| 6,701,944 | B2 | 3/2004 | McNabb | |
| 7,472,710 | B2 | 1/2009 | Jowett et al. | |
| 8,651,336 | B2 | 2/2014 | Gadini et al. | |
| 8,732,975 | B2 * | 5/2014 | Rhodes | D06F 39/12 211/1 |
| 9,163,349 | B2 | 10/2015 | Classen et al. | |
| 2010/0071729 | A1 * | 3/2010 | Classen | A47L 15/4472 134/93 |
| 2011/0180118 | A1 | 7/2011 | Schrott | |
| 2015/0359412 | A1 | 12/2015 | Delgado et al. | |

FOREIGN PATENT DOCUMENTS

| | | | | |
|---|---|---|---|---|
| CA | 2189115 | A1 | 5/1997 | |
| CN | 103132287 | A | 6/2013 | |
| CN | 104178973 | A | 12/2014 | |
| CN | 204959368 | U | 1/2016 | |
| DE | 102011006213 | A1 | 10/2012 | |
| EP | 1236431 | A2 * | 9/2002 | A47L 15/508 |
| EP | 1493375 | A1 | 1/2005 | |
| EP | 3173004 | A1 * | 5/2017 | A47L 15/22 |
| JP | 2010136795 | A * | 6/2010 | A47L 15/42 |
| WO | WO-03035961 | A2 * | 5/2003 | F25D 23/00 |

OTHER PUBLICATIONS

International Search Report and Written Opinion Issued in Application No. PCT/CN2019/075551 dated May 27, 2019.

* cited by examiner

*Primary Examiner* — Joseph L. Perrin
*Assistant Examiner* — Irina Graf
(74) *Attorney, Agent, or Firm* — Middleton Reutlinger

(57) ABSTRACT

An apparatus and method of a storage compartment for detergent items in a dish washing appliance. The dish washing door may include one or more storage compartments in a variety of locations. The storage compartment may be out of registry with a dispenser for the dish washing tub. The storage compartment may include a safety feature. The storage compartment may include a sealing mechanism.

18 Claims, 7 Drawing Sheets

DISHWASHER WITH DETERGENT STORAGE

BACKGROUND

The present embodiments relate to a method and apparatus for an appliance door, with particular embodiments shown for a dishwasher door for a dishwasher appliance.

Typical dish washing or dishwasher appliances have a detergent dispenser on the interior of the door that are used by consumers to load detergent before closing the door and beginning the wash cycle. However, this practice often requires the consumer to retrieve the detergent from a cabinet or remote location. Opening the cabinet, drawer, and/or dishwasher door may interfere with each other. Thus, there is a need for the dishwasher door to be capable of storing one or more detergent items, in a variety of forms or constructions (e.g. tablets, pods, packets, gel, liquid container(s), pills, etc.), allowing the user to store, use, and refill the detergent item(s) in a storage compartment.

SUMMARY

In some embodiments of the invention, for example, a dish washing appliance may comprise a housing having a dishwasher tub. In various embodiments, the dish washing appliance may comprise a door operably connected to the housing between an open position and a closed position. Moreover, in various embodiments, when in the open position a user may have access to the dishwasher tub. In some embodiments, the door may include one or more dispensers positionable between an open position to dispense one or more detergent items into the dishwasher tub and a closed position to hold one or more detergent items until dispensed in the open position. In addition, in various embodiments, the door includes one or more storage compartments out of registry with the one or more dispensers. In some embodiments, the one or more storage compartments may be positionable between an open position and a closed position. In various embodiments, when the one or more storage compartments are in the open position the user may refill and remove one or more detergent items from the one or more storage compartments. In some embodiments, when the one or more storage compartments are in the closed position the user may store one or more detergent items within the door.

In various embodiments, the one or more storage compartments may be located at an outer periphery of a front side of the door. In some embodiments, the one or more storage compartments may be positioned in a top side of the door. Moreover, in some embodiments, the one or more storage compartments may be positioned in a lateral side of the door. In various embodiments, the one or more storage compartments may be positioned in a front side of the door. In some embodiments, the one or more storage compartments may be positioned in an interior side of the door that may be in fluid communication with the dishwasher tub. In various embodiments, the one or more storage compartments may include a safety mechanism. Moreover, in some embodiments, the dish washing appliance may comprise a gasket sealing the one or more storage compartments in the closed position.

In some embodiments, a dish washing door for use with a dish washing appliance may comprise a front side. In various embodiments, the dish washing door may include an interior side in fluid communication with a dishwasher tub. In some embodiments, the dish washing door may include an outer periphery surrounding the front side. In addition, in some embodiments, the outer periphery may include a top side and a bottom side interconnected by a pair of lateral sides. In various embodiments, the dishwashing door may include a dispenser positionable between an open position to dispense one or more detergent items into the dishwasher tub and a closed position to hold one or more detergent items until dispensed in the open position. In some embodiments, the dish washing door may include one or more storage compartments out of registry with the dispenser for storing one or more detergent items. Moreover, in some embodiments, the one or more storage compartments may be positionable between an open position and a closed position. In various embodiments, wherein when the one or more storage compartments are in the open position the user may refill and remove one or more detergent items from the one or more storage compartments. In some embodiments, when the one or more storage compartments are in the closed position the user may store one or more detergent items within the door.

In various embodiments, the one or more storage compartments may be positioned in the top side. In some embodiments, the one or more storage compartments may be positioned in at least one of the pair of lateral sides. Moreover, in various embodiments, the one or more storage compartments may be positioned in the front side. In some embodiments, the one or more storage compartments may include a safety mechanism. In addition, in some embodiments, the one or more storage compartments may be positioned in the interior side. In various embodiments, the dish washing door may include a gasket sealing the one or more storage compartments in the closed position.

In addition, in various embodiments, a method of transferring a detergent item from a remote storage compartment of a dish washing door out of registry with a dispenser comprising the step of providing a storage compartment within a dish washing door. In some embodiments, the method may include providing a dispenser with the dish washing door out of registry with the storage compartment. In various embodiments, the method may include opening the storage compartment within the dish washing door. In some embodiments, the method may include removing a detergent item from the storage compartment. In addition, in various embodiments, the method may include closing the storage compartment within the dish washing door. In some embodiments, the method may include positioning a detergent item into the dispenser when the dispenser in is an open position.

In various embodiments, the method of opening the storage compartment may further include overcoming a safety mechanism. In some embodiments, the method of opening the storage compartment may further include the step of initially opening the dish washing door relative to a dish washing tub. In various embodiments, the method of opening the storage compartment may further include the step of at least one of pivoting and sliding the storage compartment from the dish washing door. In some embodiments, the dish washing door may include an outer periphery surrounding a front side and an interior side, wherein the outer periphery includes a top side and a bottom side interconnected by a pair of lateral sides, and wherein the storage compartment may be positioned in at least one of the top side, the front side, the interior side, and the pair of lateral sides.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
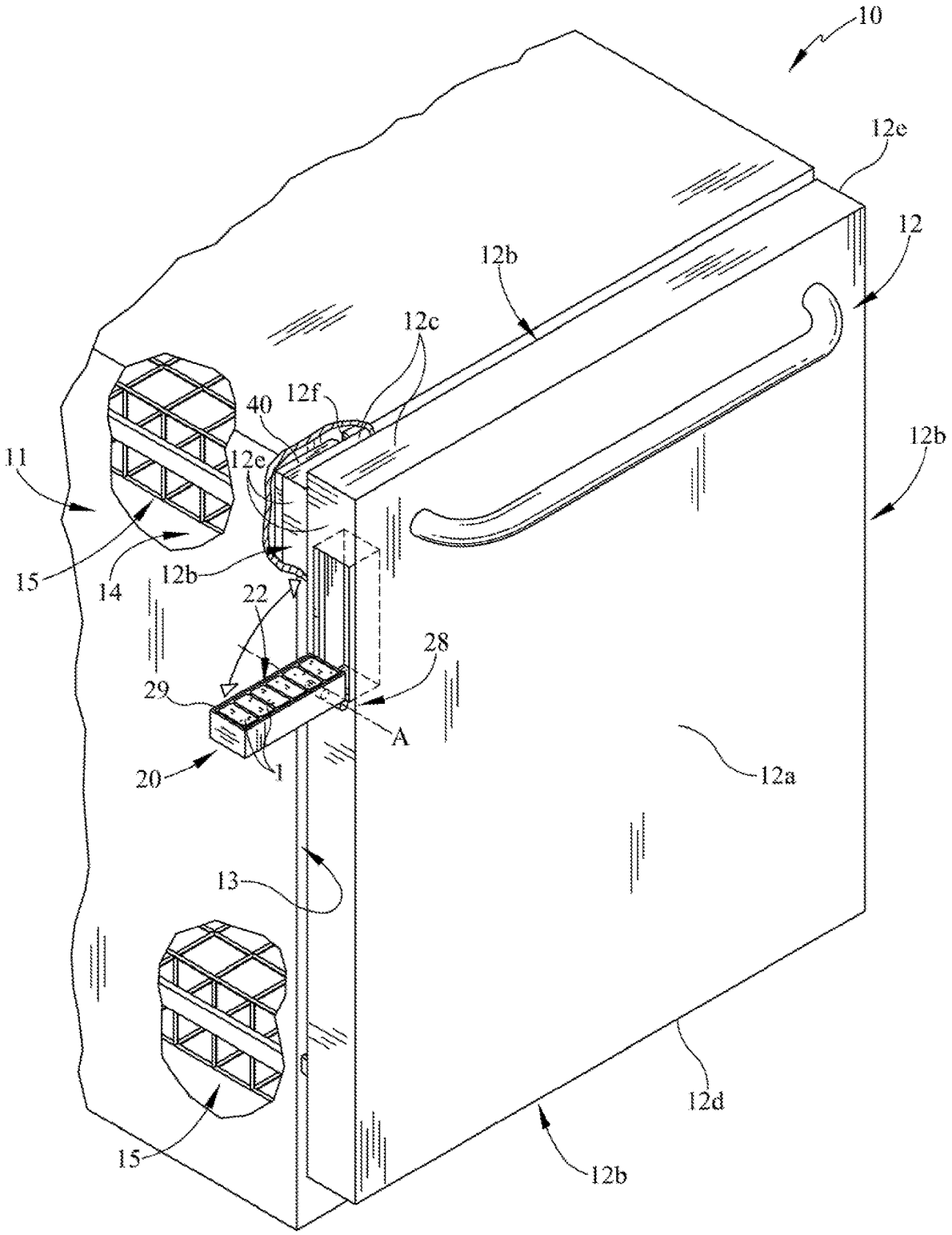
FIG. 1 is a perspective view of one embodiment of a storage compartment of a dishwasher door illustrating a deployed position by pivoting and the storage compartment in a stowed position illustrated in broken lines, with portions of the housing and dishwasher tub broken away.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a front-load residential dish washing machine such as dish washing appliance 10, such as the type that may be used in single-family or multi-family dwellings, or in other similar applications. However, it will be appreciated that the herein-described apparatus and methods may also be used in connection with other types of dish washing machines in some embodiments. For example, the herein-described apparatus and techniques may be used in commercial applications in some embodiments. Moreover, the herein-described apparatus and methods may be used in connection with other dish washing machine configurations. And even other appliances, such as, for example, ovens, refrigerators, washing machines, and the like.

Embodiments for a dish washing machine are shown herein for ease of understanding. For example, a front-load dish washing machine that includes a front-mounted door or drawer 12 in a cabinet or housing 11 that includes one or more storage compartments 20. More specifically, the storage compartment(s) may store one or more detergent items 1. Implementation of the herein-described apparatus and techniques within a variety of appliances would be well within the abilities of one of ordinary skill in the art having the benefit of the instant disclosure, so the invention is not limited to the front-load dish washing implementation discussed further herein.

Turning now to the drawings, wherein like numbers denote like parts throughout the several views, FIG. 1 illustrates an example dish washing appliance or dishwasher 10 in which the various technologies and techniques described herein may be implemented. Dish washing appliance 10 is a front-load dish washing machine, and as such may include a front-mounted door 12 defining an opening 13 that provides access to a horizontally-oriented dishwashing or dishwasher tub 14. The door 12 may be coupled with a cabinet or housing 11 that may house the dishwasher tub 14 in some embodiments. Door 12 is generally hinged along a front or front edge of the housing 11 adjacent the opening 13 and is pivotable between the open position (e.g. FIGS. 3 and 4) and a closed position (e.g. FIGS. 1 and 5). In the closed position, the door 12 may define a least a portion of the tub 14. When door 12 is in the open position, dishes, utensils, pans, and other washable items may be inserted into and removed from the one or more dishwasher racks 15 through the opening 13 in the front of cabinet or housing 11. Control over dish washing appliance 10, by a user is generally managed through a control panel 18 (e.g. FIGS. 5 and 6) disposed on a door 12 and implementing a user interface 19, and it will be appreciated that in different dish washing machine designs, control panel 18 may include various types of input and/or output devices, including various knobs, buttons, lights, switches, textual and/or graphical displays, touch screens, etc. through which a user may configure one or more settings and start and stop the dishwasher cycle(s). For example, the control panel, or portions thereof, may be included on the interior or exterior (FIG. 5) of the door.

As shown in the figures, the dish washing appliance 10 may be provided with one or more storage compartments 20. More specifically, the dishwasher door 12 includes the one or more storage compartments 20 for storage of one or more detergent items 1. The storage compartment 20 may be positionable between an open or deployed position (e.g. illustrated in solid lines in FIGS. 1-6) and a closed or stowed position (e.g. illustrated in broken lines in FIGS. 1, 2, 4, 5, and 6). In the open position, the user may have access to the contents or detergent items 1 within a cavity 22 of the storage compartment(s) 20. The user may refill and/or remove the detergent items 1 when the storage compartment 20 is open. When the storage compartment 20 is in the closed position, the user may store one or more detergent items 1 within the door 12. The storage compartments 20 are out of registry, or not in communication with, the detergent dispenser 30 (shown more clearly in FIGS. 3 and 4) to the dishwasher tub 14. Alternatively stated, the detergent items 1 may not automatically meter into the detergent dispenser 30 or into the dishwasher tub 14 from the storage compartment. As a result, in some embodiments, the user manually loads the detergent dispenser 30 by removing a detergent item 1 from the storage compartment 20 and inserting the detergent item 1 into the detergent dispenser 30 for subsequent discharge from the tub 14 during one or more cycle events. In some embodiments, the door 12 may be in the open position (e.g. FIG. 3) in order to access or open/close the storage compartment 20. Portions of the dish washing appliance 10 and/or surrounding structures (e.g. cabinets, countertops, etc.) may limit access to or operation with the storage compartments in the door's closed position. This may advantageously minimize the storage compartment from view and/or reduce undesired access in some embodiments. However, the door 12 may be in the closed position in some embodiments (e.g. FIG. 5) and still be able to operably open/close the storage compartment. Moreover, in some embodiments, the storage compartment may close automatically with the closing of the dishwasher door.

Although the storage compartment 20 remains connected with the door in the embodiments shown during the closed and open positions of the storage compartment. It should be understood, that the storage compartment 20, or portions thereof, may be separated from the door 12 when refilling, cleaning, or removing a detergent item 1 for use, etc. Stated alternatively, the storage compartment 20 or portions thereof may be removable. The storage compartment or portions thereof may be preloaded, such as a refill package or portion of the compartment/cavity with detergent items, and inserted into engagement with the dishwasher door or remaining portion of the storage compartment once the previous storage compartment is depleted from detergent use and removed (e.g. swapped out).

The detergent items 1 may be a variety of quantities, shape, sizes, materials, and constructions. For example, the one or more detergent items/dose may be a tablet, gel-pack, or pod. The term detergent item may be used interchangeably for a variety of treating chemistries for the dish washing appliance, such as rinse aid, detergent, or combinations thereof. The detergent item may be, but is not limited to, a solid, powder, liquid, or gel treating chemistries within, or not within, a pack, container, bottle, or dosing structure.

The one or more storage compartments 20 may be included in a variety of positions/locations within the dish washing or dishwasher door 12. The door 12 may include a front face or side 12*a* surrounded by an outer periphery 12*b*. The outer periphery 12*b* may include a top side 12*c* and a bottom side 12*d* interconnected by a pair or lateral sides 12*e*. An interior side 12*f* of the door 12 is adjacent the volume or tub space of the appliance or tub 14. The interior side 12*f* may define a portion of or close a portion of the opening 13 of the dishwasher tub 14 when in the closed position. The interior side may be in fluid communication with the tub 14 or internal volume defined by the tub and/or door. The outer periphery 12*b* may also be described as the portion of the door between or surrounding the interior side 12*f* and the front side 12*a* of the door 12. Portions of the door 12 may include one or more gaskets or engage one or more gaskets 40 of the housing 11 and/or dishwasher tub 14 when in the closed position. For example, the gasket 40 may engage a portion of the interior side 12*f* when the dishwasher door is in the closed position. In some embodiments, the front side 12*a* or other portions thereof may include a console or insert assembly 50 (see FIGS. 5 and 6).

Figure 3:
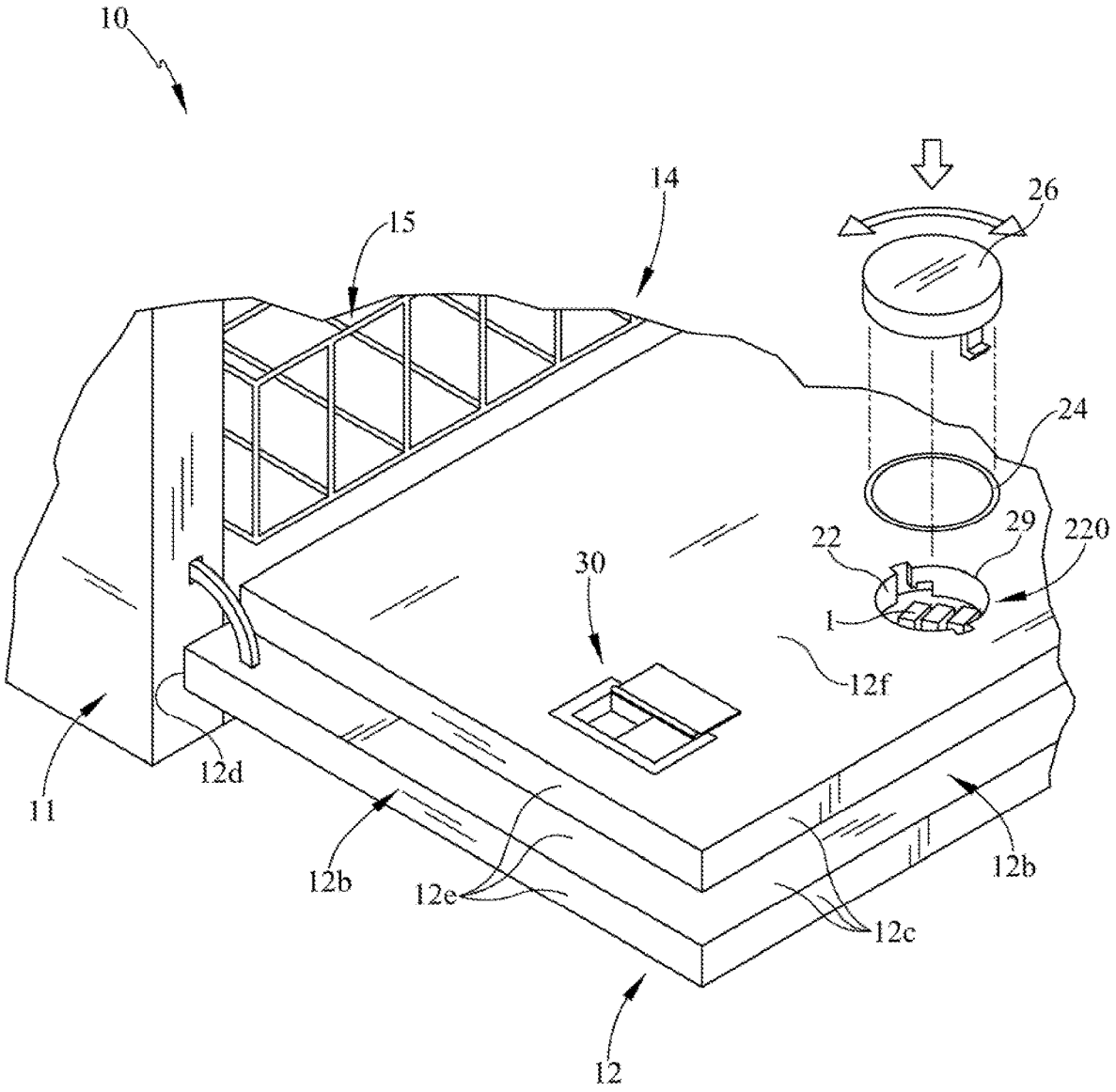
FIG. 3 is a perspective view of one embodiment of a storage compartment of a dishwasher door illustrating a safety closure and sealing mechanism exploded from the interior side of the door with portions of the door, housing, and dishwasher tub broken away.
Figure 4:
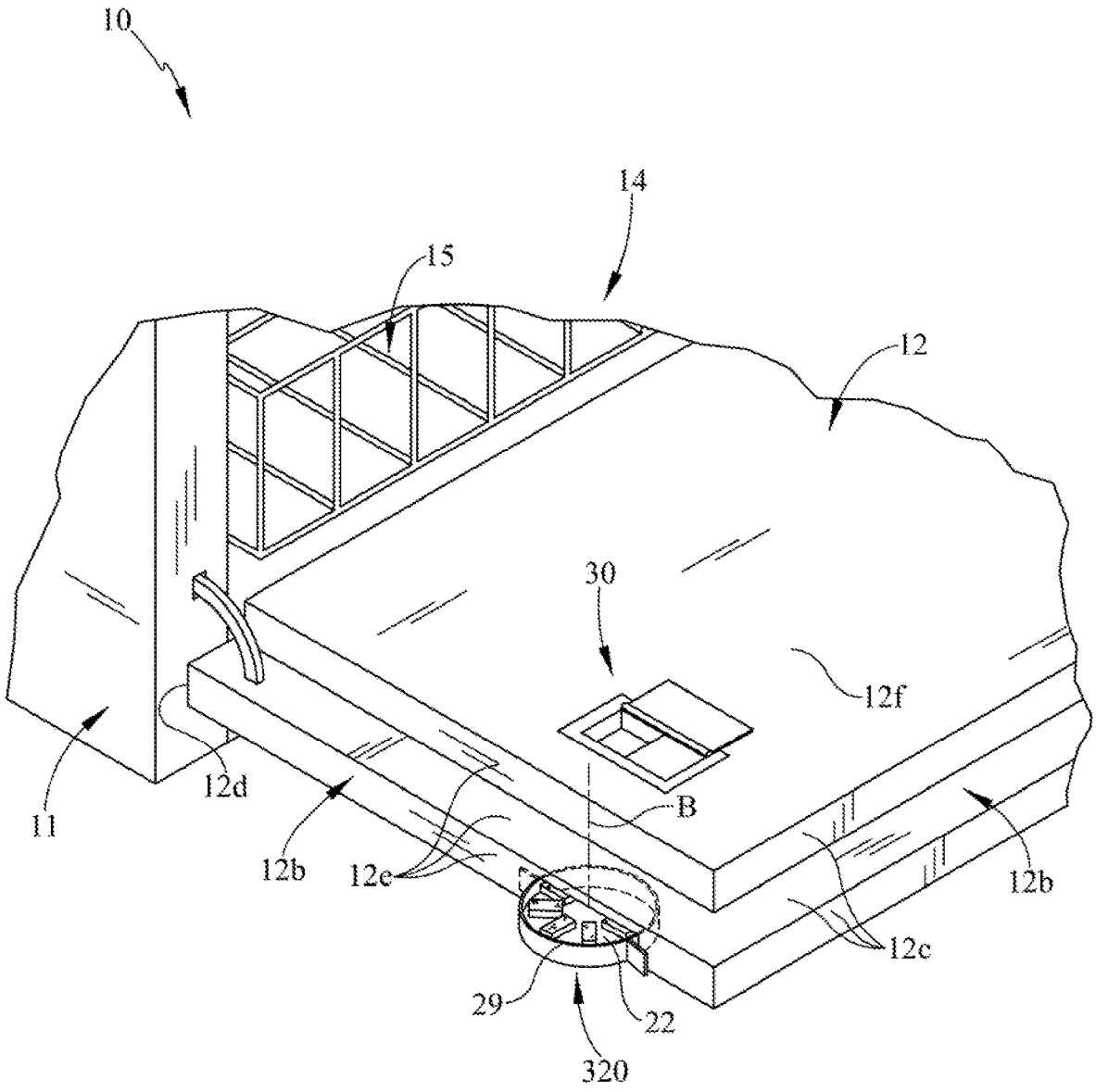
FIG. 4 is a perspective view of one embodiment of a storage compartment of a dishwasher door illustrating a deployed position by pivoting and the storage compartment in a stowed position illustrated in broken lines, with portions of the door, housing, and dishwasher tub broken away.

An embodiment of a dispenser or dispenser assembly 30 is shown in FIGS. 3 and 4. Although not shown in the other Figures, it should be understood that the dispenser 30 embodiment may be similarly positioned or included within the dishwasher door embodiments. The dispenser 30 may include an open position (as shown) and a closed position for the internal chamber. When in the closed position, the dispenser/chamber may hold one or more detergent items until dispensed into the tub 14. The dispenser 30 may hold one or more detergent items until dispensed in the open position. In some embodiments, when the dispenser is in the open position, the detergent item may fall out by gravity, by liquid sprayer, and/or mechanical assistance for example.

The one or more storage compartments may be a variety of shapes, sizes, quantities, construction, materials, and be in a variety of positions within the dishwasher door. For example, the cavity 22 defining the storage of the detergent items may be a variety of shapes and sizes. The embodiment of the cavity 22 in FIG. 4 is semi-circle in shape. The embodiment of the cavity 22 in FIGS. 1, 2, and 5-7 are substantially rectangular in shape. The movement and/or mechanism (e.g. slides, pivot, rails, guides, etc.) allowing travel of the storage compartment between a closed position and an open position may be in a variety of methods and constructions in a variety of positions within the door embodiments (e.g. sliding, pivoting, rotational, or combinations thereof). In some embodiments as shown in FIGS. 1-6, the user may remove the detergent item 1 from the cavity 22 and/or storage compartment when the storage compartment is in the open position. In other embodiments as shown in FIG. 7, the user may need to dispense the detergent item 1 from the storage compartment 620 to obtain the detergent item 1 and subsequently place into the open dispenser 30 not in registry with the storage compartment. In some embodiments in the Figures, a locking mechanism (not shown) may be used to releasably secure the storage compartment in the closed and/or open position (e.g. tab, friction fit, latch etc.), or one or more positions. The locking mechanism or catch may be released by the user in a variety of ways. For example, the user may push in to release one or more catches permitting travel between the closed position and the open position.

The one or more storage compartments may include one or more gaskets 24 that may be used to seal the cavity 22 or storage compartment in the closed position. In the open position, the storage compartment may be unsealed. One example of the storage compartment and/or door that may include a gasket 24 (e.g. O-ring) is shown in the embodiment of FIG. 3.

It should be understood, that the one or more storage compartments may include a safety mechanism or feature. A safety mechanism may reduce access to individuals who are not desired to have access to the contents or detergent items 1 of the storage compartment or access during one or more positions of the door 12. A variety of safety mechanisms may be used to maintain the storage compartment in the closed position. For example, as shown in FIG. 3, one embodiment may include a push-and-turn closure 26 to gain access to the cavity 22 or storage compartment 220.

One implementation of the one or more storage compartments 20 is shown in FIG. 1. The storage compartment 20 is shown as positioned in the outer periphery 12*b* of the dishwasher door 12. More specifically, the storage compartment 20 is positioned in at least on one lateral side 12*e*. The storage compartment 20 pivots about an axis A or hinge connection 28. The storage compartment 20 with cavity 22 pivots or flips down about the axis A from the closed position (illustrated in broken lines) to the open position (illustrated in solid lines). The cavity's opening 29 (e.g. inlet and/or outlet) may face upwardly towards the top surface 12*c* of the door. In this one embodiment, the storage compartment 20 may be accessible or may be opened when the door 12 is in the open position, or positioned out of the closed position. In this one embodiment, the storage compartment may be outside the tub 14 or sealed wash cavity. In some embodiments, the storage compartment may be at least partially inside or exposed to the wash cavity.

Figure 2:
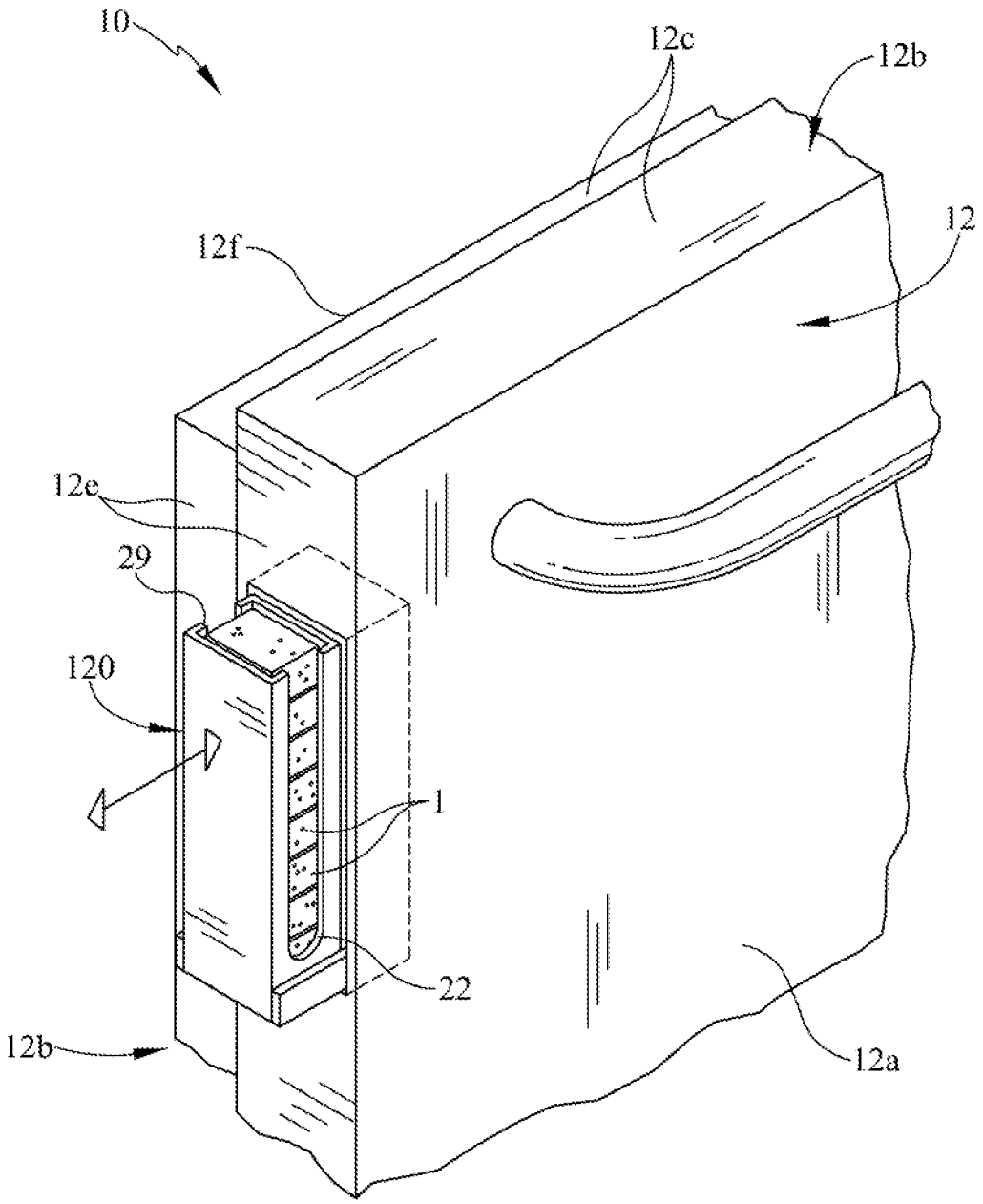
FIG. 2 is a perspective view of one embodiment of a storage compartment of a dishwasher door illustrating a deployed position by sliding or linear movement and the storage compartment in a stowed position illustrated in broken lines, with portions of the door broken away and the housing and dishwasher tub removed.

Another implementation of the storage compartment 120 included with the dishwasher door 12 is shown in FIG. 2. The storage compartment 120 may be positioned in the outer periphery 12*b* or lateral side 12*e* of the door 12. The storage compartment 120 with tray/cavity 22 slides (e.g. rails, slides, etc.) laterally out from the lateral side 12*e* of the door 12. Although the exit opening 29 for detergent items 1 is shown at the top end of the storage compartment 120, it should be understood that exit/removal opening 29 may be in variety of directions/surfaces of the storage compartment in the embodiments. The storage compartment 120 is shown as outside the tub or wash cavity 14.

Another embodiment shown in FIG. 3, illustrates a storage compartment 220 within the door and interior to the dishwasher tub 14 when the door is in the closed position. The storage compartment 220 is shown as positioned within the interior side 12*f* of the door 12. The storage compartment 220 includes one or more gaskets 24 to seal the closure 26 with the storage compartment 220 to reduce exposure to the wash tub 14 during operation (e.g. one or more cycles). As shown, the closure 26 is an example of one safety mechanism (e.g. a push-and-turn closure). Other safety mechanisms and/or gaskets may be used in various embodiments of the storage compartment at a variety of locations within the door (e.g. front side, lateral side, top side, etc.). Moreover in the embodiments, as shown more clearly in FIG. 3, the dispenser 30 is separate from and out of registry with the embodiments of the storage compartment(s) of the door 12.

Another embodiment of the storage compartment 320 within the door 12 is shown in FIG. 4. The storage compartment 320 is positioned within the lateral side 12*e* of the door periphery 12*b*. The storage compartment 320 pivots about an axis B. The semi-circular cavity 22 or storage compartment 320 is open (illustrated in solid lines) when pivoted about the axis B. In the one embodiment shown, the storage compartment 320 may be pivoted back 180 degrees and may be substantially flush with the remaining portion of the lateral side 12*e*. In the embodiment shown, the exit opening 29 of the cavity 22 faces towards the interior surface 12*f* of the door and/or tub 14.

Figure 5:
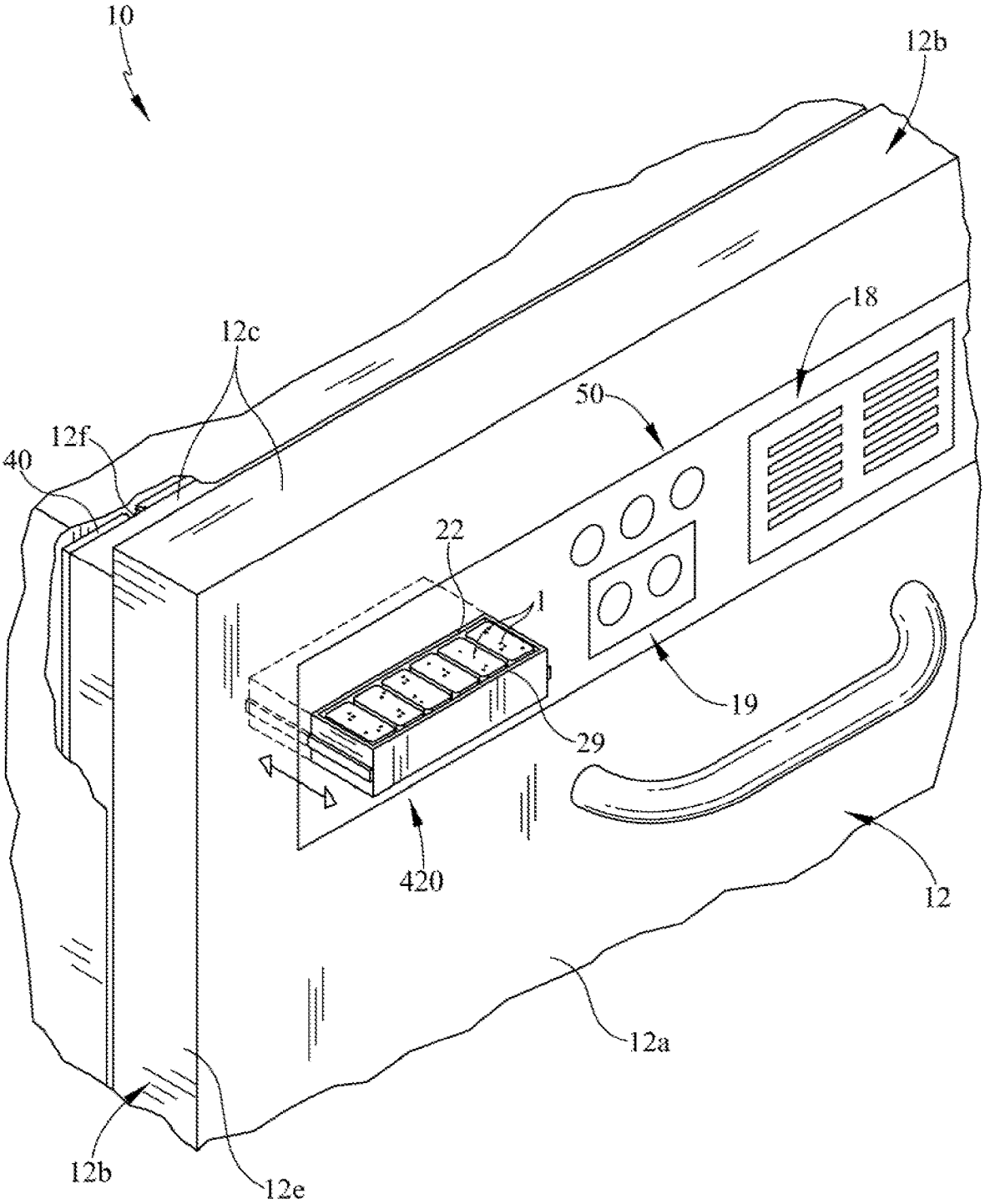
FIG. 5 is a perspective view of one embodiment of a storage compartment of a dishwasher door illustrating a deployed position by sliding or linear movement from a front side of the door and the storage compartment in a stowed position illustrated in broken lines, with portions of the door, the housing, and dishwasher tub broken away.
Figure 6:
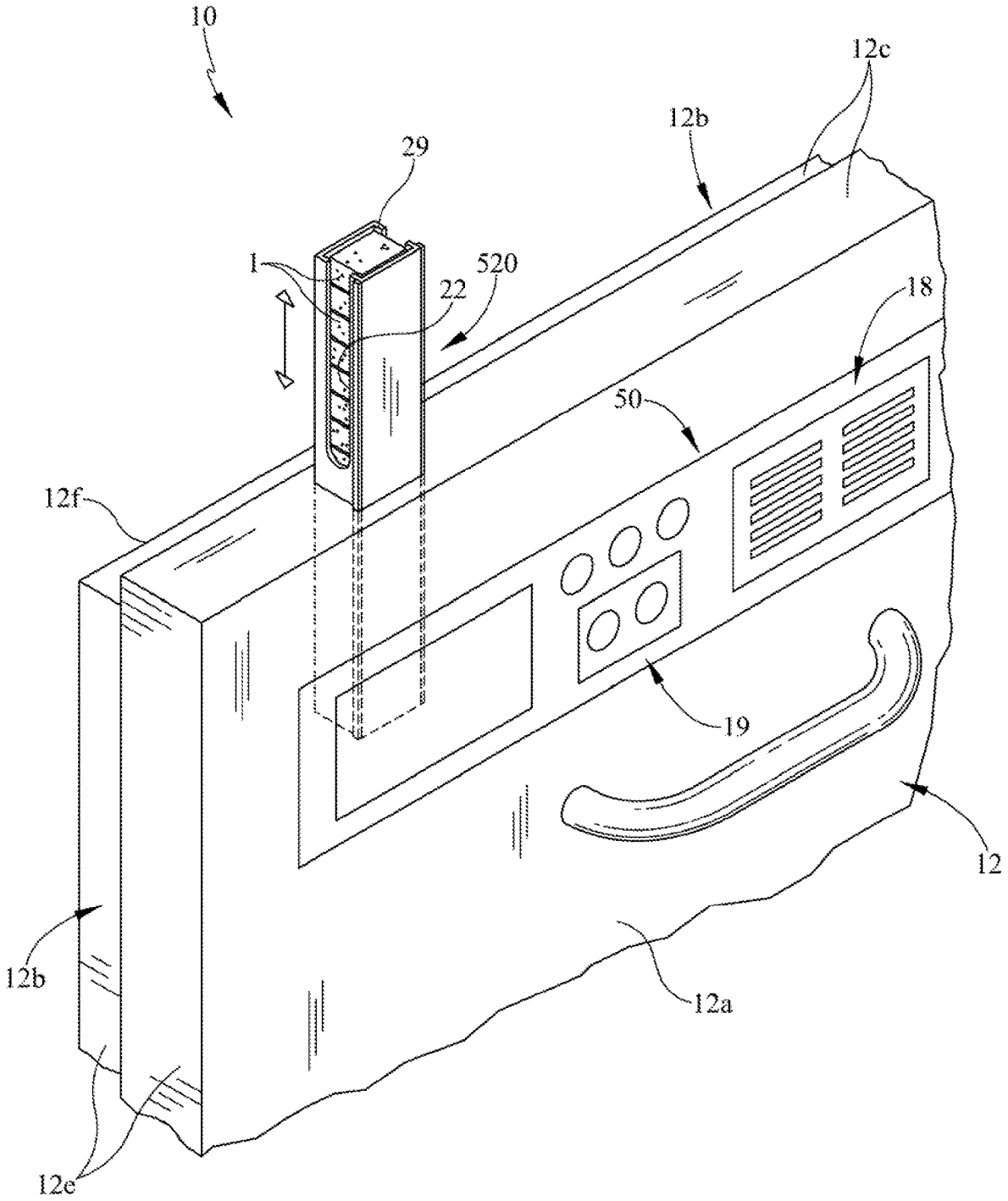
FIG. 6 is a perspective view of one embodiment of a storage compartment of a dishwasher door illustrating a deployed position by sliding or linear movement from a top side of the door and the storage compartment in a stowed position illustrated in broken lines, with portions of the door broken away and the housing and dishwasher tub removed.
Figure 7:
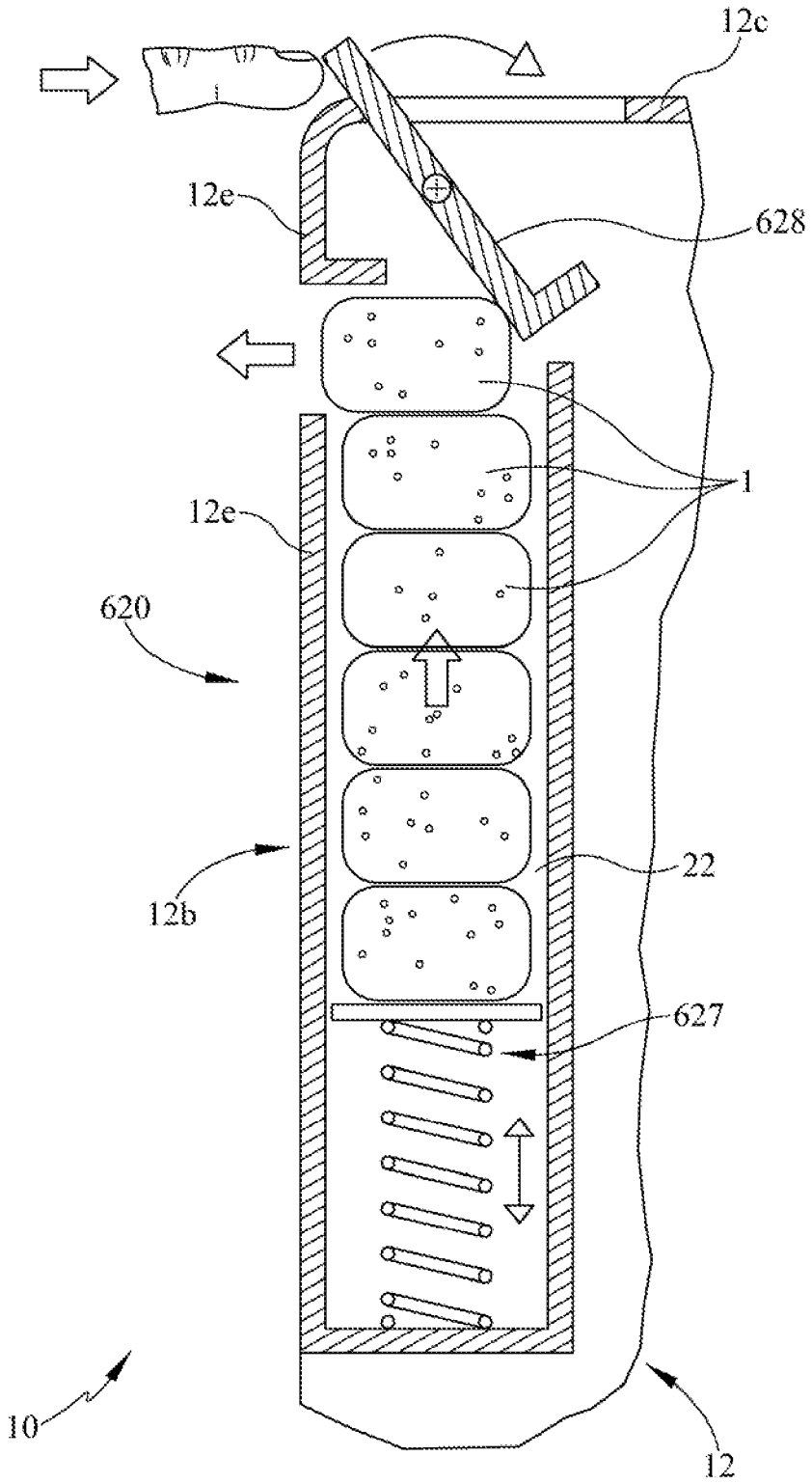
FIG. 7 is a schematic sectional view of the embodiment of a storage compartment of a dishwasher door illustrating an actuator operably removing the detergent from the storage compartment through the lateral side of the door.

As shown in FIGS. 5 and 6, another implementation of the storage compartment is shown positioned in the front side 12*a* of the dishwasher door 12. As shown in FIG. 5, the storage compartment 420 slides into and out of the door front side 12*a*. In the embodiment shown, the storage compartment may be positioned within a dishwasher console assembly 50 (e.g. insert with controls, handle, etc.). However, in some embodiments a dishwasher console assembly may not be used. In the one embodiment shown in FIG. 6, the storage compartment slides (e.g. vertically) into and out of the top side 12*c* of the door 12. In some embodiments, the console assembly may not be used.

Another implementation of the storage compartment with the door is shown in FIG. 7. The storage compartment 620 uses an actuator 628 to remove the detergent item from the cavity 22 to present a detergent item to the user. In use, the user pushes (e.g. pivots) on the actuator 628 through the top side 12*c* to meter a single detergent item out of the cavity 22 through the exit opening 29 in the lateral side 12*e* of the outer periphery 12*b*. When the actuator 628 is cycled back from holding the progression of the next detergent item 1, the spring loaded plunger 627 will meter another detergent item 1 towards the exit opening 29 within the lateral side 12*e* of the door. The exit opening 29 also may operate as an inlet for loading each detergent item into the cavity 22. Although a door or cover is not shown over the exit opening 29, it should be understood that one could be used in some embodiments.

In use, the user may supply the detergent item 1 from the remote storage compartment 20-620 of a dishwasher door 12 that is out of registry with the dispensing assembly or dispenser 30. The user may load, fill, or refill the one or more storage compartments/cavity when the storage compartment is in the open position. In some embodiments, the dishwasher door 12 may be closed and allow the storage compartment to be opened. In other embodiments, the dishwasher door 12 may be open, or in another position away from the closed position, in order to open the storage compartment. Moreover the embodiments of the door may allow the storage compartment to be opened in both the closed and open positions. In some embodiments, the user may overcome a safety mechanism to open the storage compartment. With the storage compartment open, the user may remove the detergent item from the storage compartment. The user may manual take hold of the detergent item from the cavity or storage compartment (See FIGS. 1-6), or in some embodiments the detergent item may be dispensed to the user from the storage compartment (See FIG. 7). Once the user is finished with access to the storage compartment by removing or refilling the storage compartment, the user and/or movement of the door 12 may move the storage compartment back to the closed position via, but is not limited to, at least one of rotating, pivoting, or a sliding movement (e.g. linear). The user may place the detergent item into an opened dispenser 30 or upon opening the dispenser.

Although the storage compartment is shown in the figures, it should be understood that the storage compartment may be a variety of sizes, shapes, quantities, and construction within the door and still be within the scope of the teachings herein. For example, the storage compartment may be located in a variety of positions within the door and still be within the scope of the invention.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dish washing appliance comprising:

a housing having a dishwasher tub;

a door operably connected to the housing between an open position and a closed position, when in the open position a user has access to the dishwasher tub;

wherein the door includes one or more dispensers positionable between an open position to dispense one or more detergent items into the dishwasher tub and a closed position to hold one or more detergent items until dispensed in the open position; and wherein the door includes one or more storage compartments out of registry with the one or more dispensers and the dishwasher tub and not in communication with the dishwasher tub when the door is in the closed position, the one or more storage compartments are positionable between an open position and a closed position, wherein in the open position the user can refill and remove one or more detergent items from the one or more storage compartments and when in the closed position the user can store one or more detergent items within the door.

2. The dish washing appliance of claim 1 wherein the one or more storage compartments are located at an outer periphery of a front side of the door.

3. The dish washing appliance of claim 2 wherein the one or more storage compartments are positioned in a top side of the door.

4. The dish washing appliance of claim 2 wherein the one or more storage compartments are positioned in a lateral side of the door.

5. The dish washing appliance of claim 1 wherein the one or more storage compartments are positioned in a front side of the door.

6. The dish washing appliance of claim 1 wherein the one or more storage compartments include a safety mechanism.

7. The dish washing appliance of claim 1 further comprising a gasket sealing the one or more storage compartments in the closed position.

8. A dish washing door for use with a dish washing appliance comprising:

a front side;

an interior side in fluid communication with a dishwasher tub;

an outer periphery surrounding the front side, wherein the outer periphery includes a top side and a bottom side interconnected by a pair of lateral sides;

a dispenser positionable between an open position to dispense one or more detergent items into the dishwasher tub and a closed position to hold the one or more detergent items until dispensed in the open position; and one or more storage compartments for storing the one or more detergent items, wherein the one or more storage compartments are out of registry with the dispenser and the dishwasher tub and not in communication with the dishwasher tub when the dish washing door is in a closed position, wherein the one or more storage compartments are positionable between an open position and a closed position, wherein in the open position of the one or more storage compartments a user can refill and remove the one or more detergent items from the one or more storage compartments, and when in the closed position of the one or more storage compartments the user can store the one or more detergent items in the one or more storage compartments within the dish washing door.

9. The dish washing door of claim 8 wherein the one or more storage compartments are positioned in the top side.

10. The dish washing door of claim 8 wherein the one or more storage compartments are positioned in at least one of the pair of lateral sides.

11. The dish washing door of claim 8 wherein the one or more storage compartments are positioned in the front side.

12. The dish washing door of claim 8 wherein the one or more storage compartments include a safety mechanism.

13. The dish washing door of claim 8 further comprising a gasket sealing the one or more storage compartments in the closed position.

14. A method of transferring a detergent item from a storage compartment provided within a dish washing door to a dispenser provided with the dish washing door, wherein the storage compartment is out of registry with the dispenser and a dishwasher tub and not in communication with the dishwasher tub when the dish washing door is in a closed position, the method comprising the steps of:

opening the storage compartment within the dish washing door;

removing a detergent item from the storage compartment;

closing the storage compartment within the dish washing door; and positioning the detergent item into the dispenser when the dispenser in is an open position.

15. The method of claim 14 wherein the step of opening the storage compartment further includes overcoming a safety mechanism.

16. The method of claim 14 wherein the step of opening the storage compartment further includes the step of initially opening the dish washing door relative to the dish washing tub.

17. The method of claim 14 wherein the step of opening the storage compartment further includes the step of at least one of pivoting and sliding the storage compartment from the dish washing door.

18. The method of claim 14 wherein the dish washing door includes an outer periphery surrounding a front side and an interior side, wherein the outer periphery includes a top side and a bottom side interconnected by a pair of lateral sides, and wherein the storage compartment is positioned in at least one of the top side, the front side, and the pair of lateral sides.

* * * * *